US005419535A

United States Patent [19]

Roberts et al.

[11] Patent Number: 5,419,535

[45] Date of Patent: May 30, 1995

[54] TONGUE AND GROOVE PRESS TOOL

[76] Inventors: Jake Roberts; Jacob Roberts, both of 314 McCray Dr., Albany, Ga. 31701

[21] Appl. No.: 134,699

[22] Filed: Oct. 12, 1993

[51] Int. Cl.[6] ..... B66F 3/00

[52] U.S. Cl. ..... 254/15

[58] Field of Search ..... 254/15–17, 254/11, 113

[56] References Cited

U.S. PATENT DOCUMENTS

| | | | |
|---|---|---|---|
| 396,104 | 1/1889 | Morrill et al. | 254/15 |
| 2,877,983 | 3/1959 | Hidalgo | 254/17 |
| 4,620,691 | 11/1986 | Waters | 254/16 |
| 4,667,747 | 5/1987 | Falls et al. | 81/44 |
| 5,139,231 | 8/1992 | Temple | 254/16 |

*Primary Examiner*—Robert C. Watson

[57] ABSTRACT

A tongue and groove press tool to assist carpenters in holding material overhead while nailing roofing material in place comprising a tongue and groove press tool to assist carpenters in holding material overhead while nailing, the held material in place comprising a base adapted to be secured to an existing stud of a structure receiving the material, the base including a channel member and a downwardly facing longitudinal extension, a rod formed of extension front and rear members, the forward end of the push rod having a support for receiving and supporting roofing material overhead to be nailed, and a handle having a grip at the lower end and a clevis at the upper end whereby when the base is secured to a stud and a handle pushed forwardly with an edge of the material to be supported is in contact with the base, then the tool will hold the material in place.

4 Claims, 4 Drawing Sheets

TONGUE AND GROOVE PRESS TOOL

BACKGROUND OF THE INVENTION

1. Field of the Invention

The present invention relates to a tongue and groove press tool and more particularly pertains to tool which may be used to hold material overhead while nailing in place.

2. Description of the Prior Art

The use of construction tools is known in the prior art. More specifically, construction tools heretofore devised and utilized for the purpose of handling sheet material are known to consist basically of familiar, expected and obvious structural configurations, notwithstanding the myriad of designs encompassed by the crowded prior art which have been developed for the fulfillment of countless objectives and requirements.

The prior art for example discloses various devices for various purposes. By way of example, U.S. Pat. Nos. 4,197,626 to Golovich; Des. 324,345 to Demoulpied; and 4,164,346 to Sickler relate to devices for supporting sheet like construction materials. U.S. Pat. Nos. 3,562,908 to Rogers and 4,719,827 to Igarasahi disclose tools having mechanisms utility in the carpentry and construction fields. Nothing is directed to the tool structurally or functionally as disclosed herein.

In this respect, the tongue and groove press tool according to the present invention substantially departs from the conventional concepts and designs of the prior art, and in so doing provides an apparatus primarily developed for the purpose of supporting sheet material.

Therefore, it can be appreciated that there exists a continuing need for new and improved tongue and groove press tool which can be used for supporting sheet material overhead. In this regard, the present invention substantially fulfills this need.

SUMMARY OF THE INVENTION

In view of the foregoing disadvantages inherent in the known types of construction tools now present in the prior art, the present invention provides an improved tongue and groove press tool. As such, the general purpose of the present invention, which will be described subsequently in greater detail, is to provide a new and improved tongue and groove press tool apparatus and method which has all the advantages of the prior art construction devices and none of the disadvantages.

To attain this, the present invention essentially comprises a tongue and groove press tool to assist carpenters in holding material overhead while nailing roofing material in place comprising, in combination a tongue and groove press tool to assist carpenters in holding sheet material overhead while nailing such sheet material in place comprising, in combination a base adapted to be secured to an existing stud of a structure to receive the sheet material, the base including a channel member with upwardly facing longitudinal walls on the sides thereof and a downwardly facing longitudinal extension in the center thereof, an end hole extending through the extension adjacent to the front end and the back end and a central bracket with a hole perpendicular to the end holes for supporting a clamp, the base also including a plate positionable in the channel member with upwardly facing spikes for penetrating an existing stud; a rod formed of an exterior front member and an interior rear member, the front end of the rear member being configured for receiving the rear end of the front and with aligned coupling holes in the front and rear members for coupling with a pin to vary the length of the rod, the forward end of the rod having an upwardly facing L shaped cross sectional support for receiving and supporting sheet material overhead to be nailed, the rear end of the rod being formed as a clevis with a pin extending through the clevis and the hole at the rear end of the base, and a collar sliding received over the front and rear members of the rod with a pin in alignment with the aligned coupling holes of the rod, the pin extending therethrough for coupling the rod members and collar against axial movement with respect to each other; a handle having a grip at the lower end and a clevis at the upper end with a pin coupling the clevis and the hole at the rear end of the base for rotational movement therebetween, a hole in a central extent of the handle with a pin extending therethrough and through the clevis at the rear end of the rod for rotational movement therebetween whereby when the base is secured to a stud and a handle pushed forwardly with an edge of the sheet material is within the support bracket of the rod, then the tool will hold the sheet panel in place; and a clamp pivotally secured at a central extent to the central bracket of the base with downwardly extending handles for manipulation by the user and upwardly extending fingers to grasp the stud supporting the base.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tongue and groove press tool which has all the advantages of the prior art construction tools and none of the disadvantages.

It is another object of the present invention to provide a new and improved tongue and groove press tool which may be easily and efficiently manufactured and marketed.

It is a further object of the present invention to provide a new and improved tongue and groove press tool which is of a durable and reliable construction.

An even further object of the present invention is to provide a new and improved tongue and groove press tool which is susceptible of a low cost of manufacture with regard to both materials and labor, and which accordingly is then susceptible of low prices of sale to the consuming public, thereby making such tongue and grove press tool economically available to the buying public.

Still yet another object of the present invention is to provide a new and improved tongue and groove press tool which provides in the apparatuses and methods of the prior art some of the advantages thereof, while simultaneously overcoming some of the disadvantages normally associated therewith.

Still another object of the present invention is to render the nailing up of ceiling materials a one person job.

Yet another object of the present invention is to employ tooling, rather than a second worker, to hold overhead materials in place while nailing.

Even still another object of the present invention is to provide a new and improved tongue and groove press tool to assist carpenters in holding material overhead while nailing roofing material in place comprising, a tongue and groove press tool to assist carpenters in holding material overhead while nailing, the held material in place comprising a base adapted to be secured to an existing stud of a structure receiving the material, the base including a channel member and a downwardly facing longitudinal extension, holes extending through the extension adjacent to the front end and the back end the base also including upwardly facing spikes for penetrating an existing stud; a rod formed of extension front and rear members, the front end of the rear member being configured for receiving the rear end of the front member and with aligned coupling holes, therethrough to vary the length of the rod, the forward end of the push rod having a support for receiving and supporting roofing material overhead to be nailed, the rear end of the push rod being formed as a clevis with a pin extending through the clevis and the adjacent hole at the rear end of the base, and a collar slidingly received over the front and rear member of the rod with a hole in alignment with holes of the rod and a pin extending therethrough for coupling the push rod members and collar against axial movement with respect to each a handle having a grip at the lower end and a clevis at the upper end and with a pin coupling the clevis and the hole at the rear end of the base for rotational movement, a hole in the central extent of the handle with a pin extending therethrough and through the clevis at the rear end of the rod for rotational movement therebetween whereby when the base is secured to a stud and a handle pushed forwardly with an edge of the material to be supported is in contact with the base, then the tool will hold the material in place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
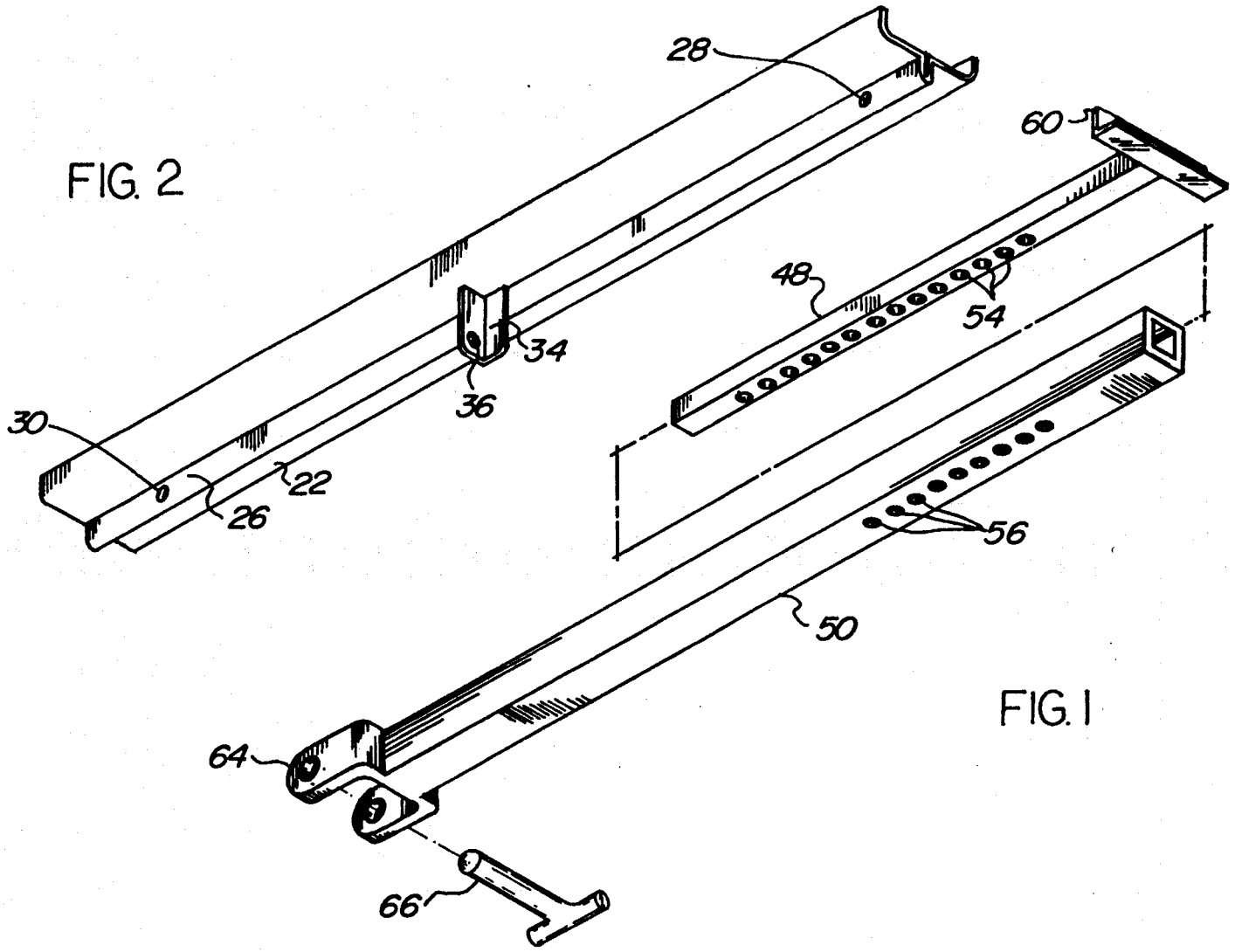
FIG. 1 is a perspective exploded view of a principal component of the tongue and groove press tool constructed in accordance with the principles of the present invention.
FIG. 2 is an exploded perspective view of the push rod of the tongue and groove press tool.
Figures 3, 4, 5:
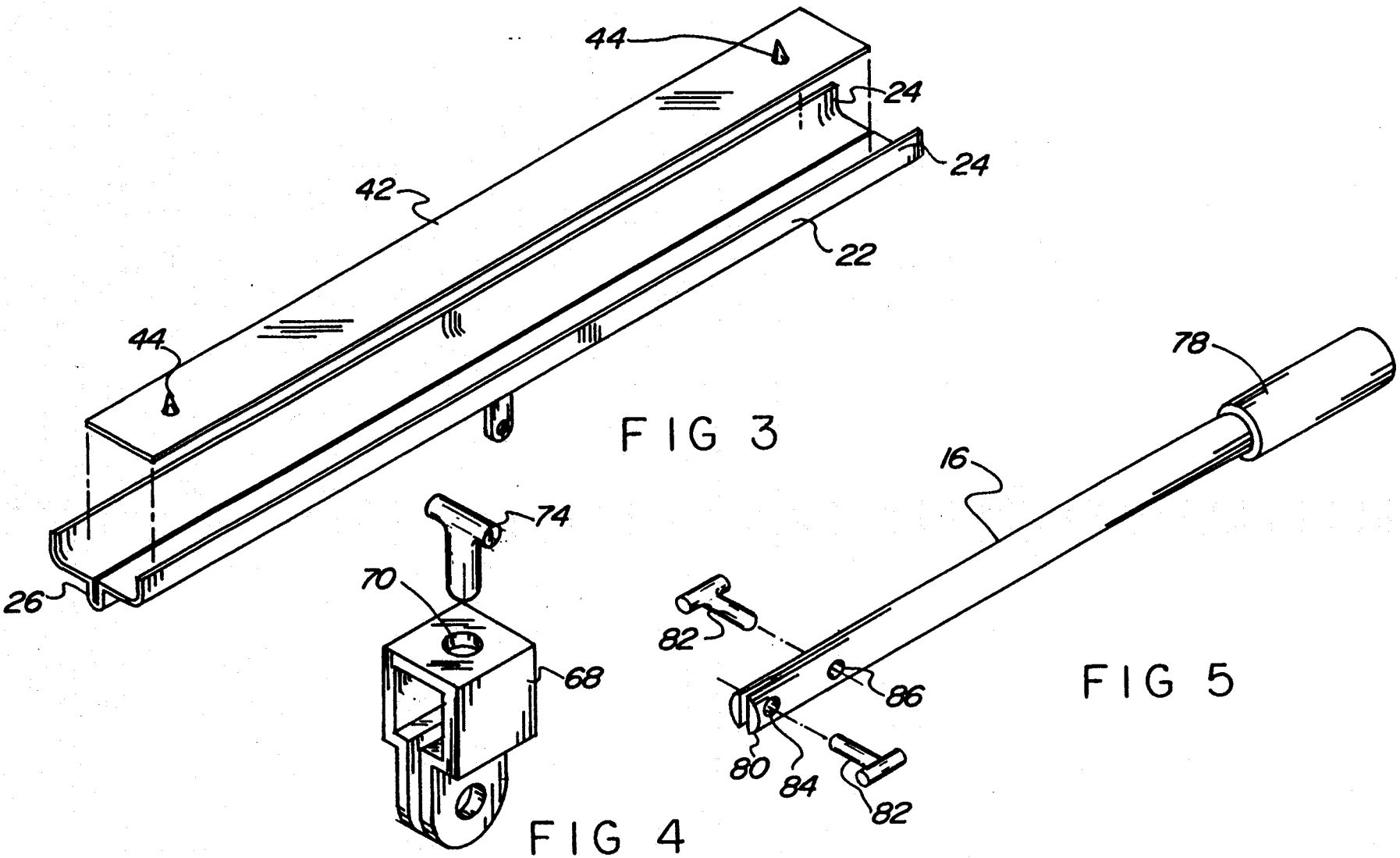
FIG. 3 is a perspective illustration of the push rod as shown in FIG. 2 but viewed from the opposite side.
FIG. 4 is a perspective view of the collar of the tongue and groove press tool.
FIG. 5 is a perspective view of the push handle of the tongue and groove press tool.

With reference now to the drawings, and in particular to FIG. 1 thereof, a new and improved tongue and groove press tool embodying the principles and concepts of the present invention and generally designated by the reference numeral 10 will be described.

Figures 6, 7:
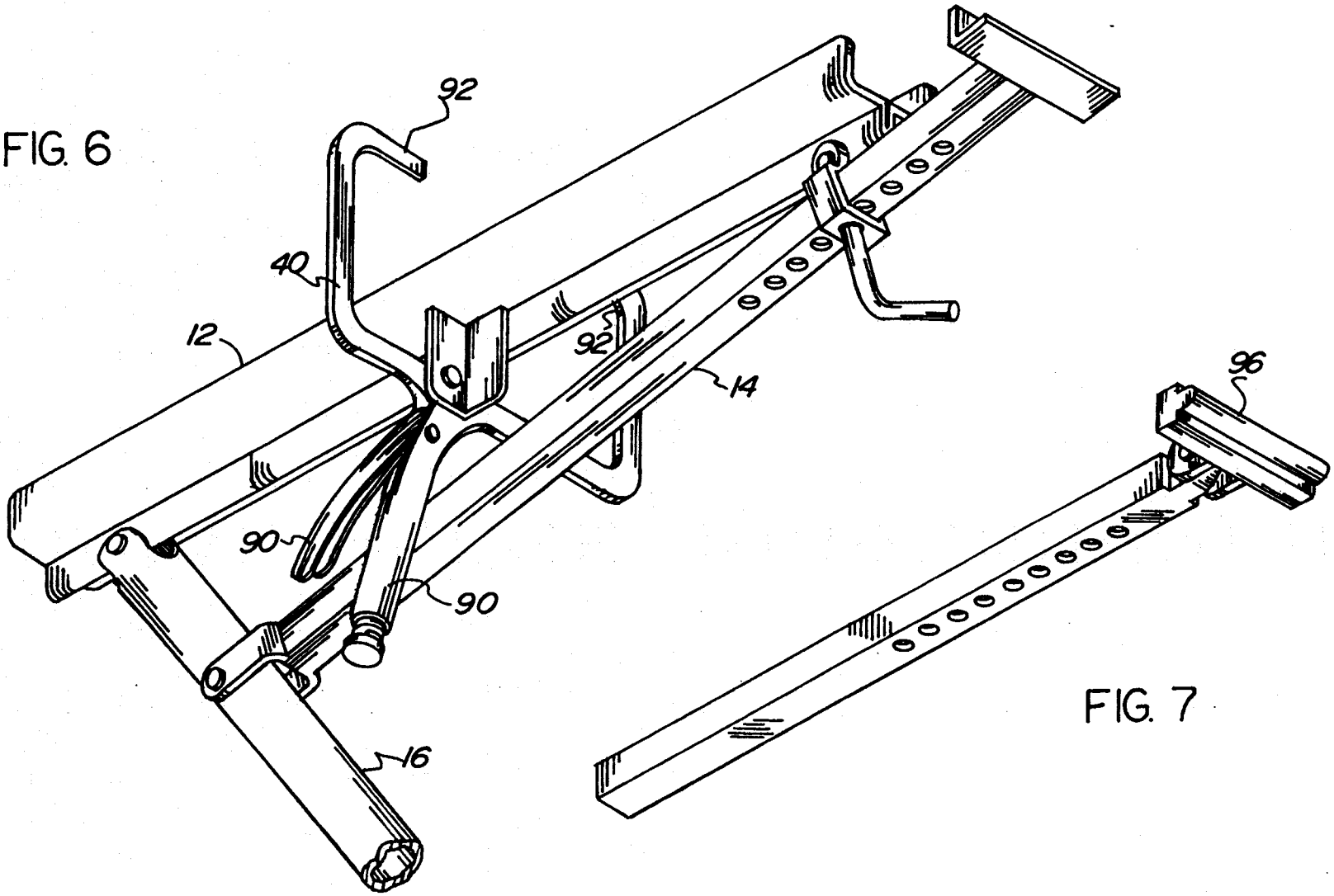
FIG. 6 is a perspective view of the entire tongue and groove press tool which includes the components of the prior figures but coupled together for operation and the use.
FIG. 7 illustrates an alternate embodiment employing a push rod of a different configuration.

More specifically, the present invention assembled for operation and use is best seen in FIG. 6. As will become apparent, the tongue and groove press tool 10 of the present invention functions to assist carpenters in holding ceiling material in sheet form overhead while nailing it in place. The tool 10 comprises in its simplest terms, a base 12, a rod 14 and a handle 16. In addition, a clamp 18 may also be utilized if needed or desired. The base 12 is adapted to be secured to an existing stud of a structure receiving the sheet ceiling material. The base 12 includes a channel member 22 with upwardly facing longitudinal walls 24 on the sides thereof and a downwardly facing longitudinal extension 26 in the center thereof front and rear holes 28 and 30 extend through the extension adjacent to the front end and the rear end 4 thereof in addition a bracket provided with a central hole 36 perpendicular to the end holes. The bracket 34 is for supporting a clamp 40.

The base 12 also included a plate 42. Such plate is positioned in the channel member 22 with upwardly facing spikes 44 for penetrating an existing stud in the region where the material is to be mailed.

A rod 14 is formed of an exterior front member 48 and an interior rear member 50. The front end of the rear member is configured for receiving the rear end of the front member. Aligned coupling holes 54 and 56 in the front and rear members function to vary the length of the push rod. The forward end of the push rod is formed with an L-shaped cross sectional support 60 for receiving and supporting sheet ceiling material overhead to be nailed.

The rear end of the rod 14 is formed with a clevis 64. A pin 66 extends through the clevis and the hole 30 at the rear end of the handle. A collar 68 is slidingly received over the front and rear members of the rod and includes a hole 70 in alignment with the aligned coupling holes 54 and 56 of the rod 14 and a pin 74 extends therethrough for coupling the rod members and collar against axial movement with respect to each other. The pin is inserted through rod 14 and collar 68 after the handle is actuated. The selection of the paper holes 54 and 56 allows the user of the tool to vary the length of the rod 14 for a particular application.

A handle 16 is also provided. The handle has a grip 78 at the lower end and a clevis at the upper end. A pin 82 couples the clevis 80 through its hole 84 with the rear end of the base for rotational movement. A hole 86 in the central extent of the handle receives a pin 88 extending therethrough and through the clevis 64 at the rear end of the rod. Rotation of the handle thus impairs rotational movement to the rod whereby when the base is secured to a stud and the handle pushed forwardly and with an edge of the material to be supported located within the support bracket 60 of the base 12, then the tool 10 will hold the sheet material in place for being nailed to the ceiling.

Lastly a clamp 40 is pivotally pinned at a central extent to the central bracket 34 of the base. Downwardly extending handles 90 and upwardly extending fingers 92 function to grasp the opposed faces of a stud supporting the base. This provides additional securement of the tool to the tool to the stud during operation and use.

Figure 8:
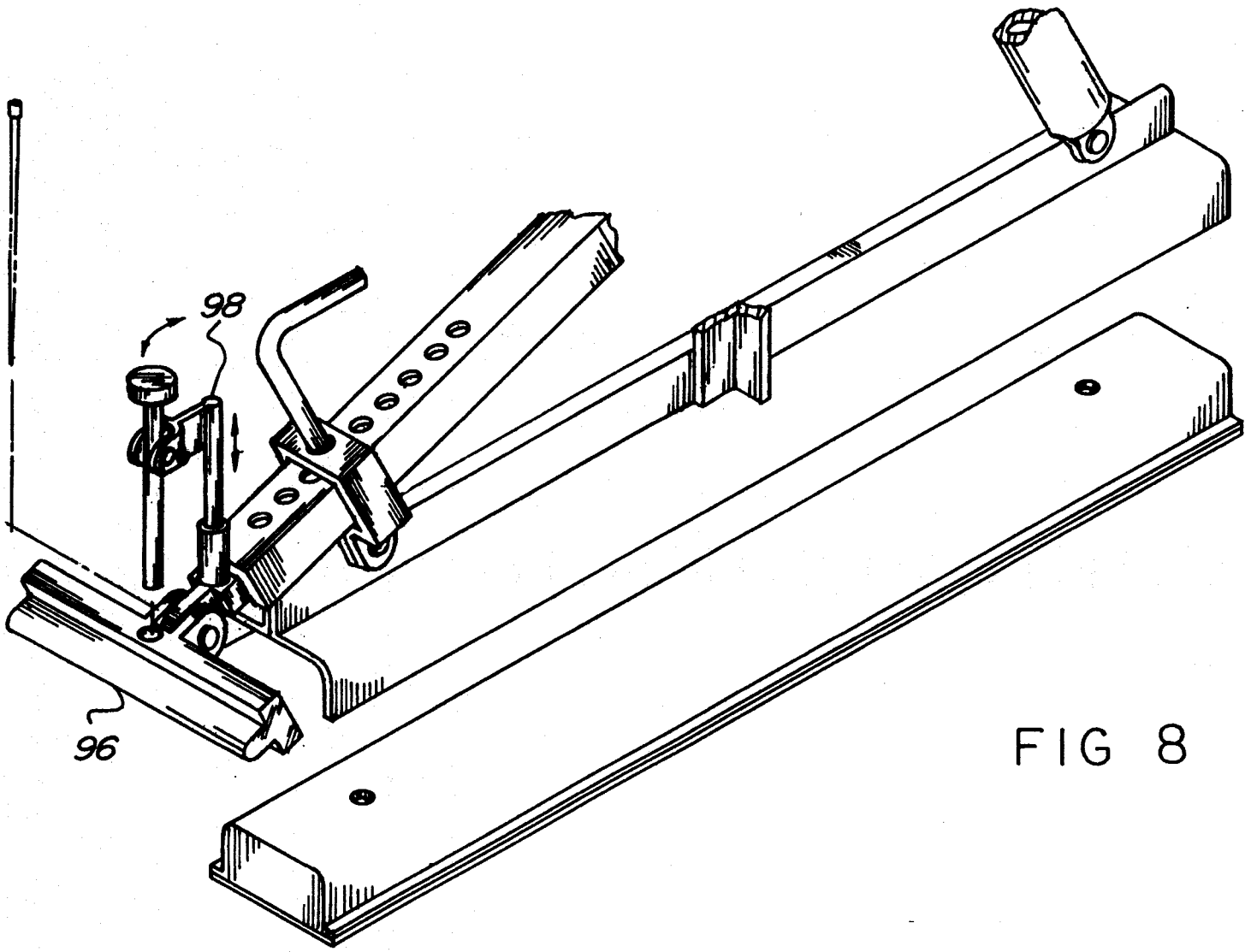
FIG. 8 is a perspective view of the entire tongue and groove press tool constructed in accordance with the alternate embodiment of the present invention.

An alternate embodiment of the invention is shown in FIGS. 7 and 8. Such apparatus employs a modified sheet support member in the forward end of the rod 14. The support includes a tongue shaped member 96 insertable into the groove of a ceiling panel. The member is rotatably pinned to the forward end of the rod 14. In addition a nail inserting mechanism or tool 98 is adjustably coupled with respect thereto to assist the user in driving the first supporting nail. As can be understood from an inspection of the FIG. 8 embodiment, the reciprocating member 98 is adapted to hold a nail adjacent to the tongue-shaped member 96 so that the held nail may be driven into such member upon the striking of the member 98 as by a hammer to drive the nail.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A tongue and groove press tool to assist carpenters in holding sheet material overhead while nailing such sheet material in place comprising, in combination:

a base adapted to be secured to an existing stud of a structure to receive the sheet material, the base including a channel member with upwardly facing longitudinal walls on the sides thereof and a downwardly facing longitudinal extension in the center thereof, an end hole extending through the extension adjacent to the front end and the back end and a central bracket with a hole perpendicular to the end holes for supporting a clamp, the base also including a plate positionable in the channel member with upwardly facing spikes for penetrating an existing stud;

a rod formed of an exterior front member and an interior rear member, the front end of the rear member being configured for receiving the rear end of the front end and with aligned coupling holes in the front member and rear member for coupling with a pin to vary the length of the rod, the forward end of the rod having an upwardly facing L-shaped cross-sectional support for receiving and supporting sheet material overhead to be nailed, the rear end of the rod being formed as a clevis with a pin extending through the clevis and the hole at the rear end of the handle, and a collar slidably received over the front and rear members of the rod with a pin in alignment with the aligned coupling holes of the rod, the pin extending therethrough for coupling the rod members and collar against axial movement with respect to each other;

a handle having a grip at the lower end and a clevis at the upper end with a pin coupling the clevis and the hole at the rear end of the base for rotational movement therebetween whereby when the base is secured to a stud and a handle pushed forwardly with an edge of the sheet material is within the support bracket of the rod, then the tool will hold the sheet panel in place; and a clamp pivotally secured at a central extent to the central bracket of the base with downwardly extending handles for manipulation by the user and upwardly extending fingers to grasp the stud supporting the base.

2. A tongue and groove press tool to assist carpenters in holding material overhead while nailing, the held material in place comprising:

a base adapted to be secured to an existing stud of a structure receiving the material, the base including a channel member and a downwardly facing longitudinal extension, holes extending through the extension adjacent to the front end and the back end, the base also including upwardly facing spikes for penetrating an existing stud;

a push rod formed of extension front and rear members, the front end of the rear member being configured for receiving the rear end of the front member and with aligned coupling holes, therethrough to vary the length of the rod, the forward end of the push rod having a support for receiving and supporting roofing material overhead to be nailed, the rear end of the push rod being formed as a clevis with a pin extending through the clevis and the adjacent hole at the rear end of the handle, and a collar slidingly received over the front and rear members of the rod with a hole in alignment with holes of the rod and a pin extending therethrough for coupling the push rod members and collar against axial movement with respect to each other; and a handle having a grip at the lower end and a clevis at the upper end and with a pin coupling the clevis and the hole at the rear end of the base for rotational movement, a hole in the central extent of the handle with a pin extending therethrough and through the clevis at the rear end of the rod for rotational movement therebetween whereby when the base is secured to a stud and a handle pushed forwardly with an edge of the material to be supported is in contact with the base, then the tool will hold the material in place.

3. The apparatus as set forth in claim 2 wherein the forward end of the rod includes a support member with an L shaped cross section.

4. The apparatus as set forth in claim 2 wherein the forward end of the rod includes a tongue shaped member insertable into the groove of a ceiling panel.

* * * * *